United States Patent [19]

Howard et al.

[11] 4,088,187

[45] May 9, 1978

[54] WELL STEAM SAMPLER APPARATUS AND METHOD OF FORMING AND USING A WELL STEAM SAMPLER

[75] Inventors: Curtis E. Howard, Porter; Douglas G. Calvin, Missouri City, both of Tex.

[73] Assignee: Texaco Inc., New York, N.Y.

[21] Appl. No.: 789,391

[22] Filed: Apr. 21, 1977

[51] Int. Cl.[2] ..... E21B 47/00

[52] U.S. Cl. ..... 166/264; 166/169; 73/155

[58] Field of Search ..... 166/264, 162, 169; 73/155

[56] References Cited

U.S. PATENT DOCUMENTS

| | | | |
|---|---|---|---|
| 2,171,000 | 8/1939 | Iden | 166/164 X |
| 3,103,813 | 9/1963 | Bourne, Jr. et al. | 73/155 |
| 3,249,054 | 5/1966 | Hill | 73/155 X |
| 3,934,469 | 1/1976 | Howard et al. | 73/155 |
| 3,981,189 | 9/1976 | Howard et al. | 166/264 X |

*Primary Examiner*—Stephen J. Novosad
*Attorney, Agent, or Firm*—Carl G. Ries; Thomas H. Whaley; Theron H. Nichols

[57] ABSTRACT

Two methods and a steam sampler are disclosed for sampling steam, as at any desired depth in a steam injection well for determining the quality of the saturated steam just prior to penetrating the formation. The sampler comprises an elongated cylindrical vessel with a tube having openings extending longitudinally internally of the vessel for forming an annulus between the vessel and the tube for trapping steam water droplets while ejecting the steam vapor. The tube has a suitable number of staggered perforated baffles thereon for closing the top of the annulus for preventing loss of the water droplets due to vapor flashing when pressure is bled off for recovery at the surface. A method for sampling and a method for forming a sampler are disclosed. Thus, a simpler, stronger sampler with no moving parts and new and improved methods are disclosed.

16 Claims, 4 Drawing Figures

WELL STEAM SAMPLER APPARATUS AND METHOD OF FORMING AND USING A WELL STEAM SAMPLER

BACKGROUND OF THE INVENTION

The disclosed invention is an improvement over inventors' prior invention U.S. Pat. No. 3,934,469, issued Jan. 27, 1976.

As an aid to improving steam flood efficiency in secondary recovery in old oil or depleted wells for example, it is greatly beneficial to know the steam quality at any particular location in the well or sandface of a steam injection well. It would be desirable to collect and trap a representative sample of the steam liquid phase or water droplets flowing to the surface and retrieve this sample for analyzing while the steam vapor phase or vapor passes on through. The sample could then be checked for either total dissolved solids or chloride content and compared to the steam generator feedwater total dissolved solids or chlorides. Hence, the quality may be determined from a ratio of the total dissolved solids or chlorides of the steam entering the wellhead to the total dissolved solids or chlorides in the steam water droplets from the sampler at any desired location in the well, as at the bottom of the well, if so desired.

OBJECTS OF THE INVENTION

Accordingly, a primary object of this invention is to provide at least one method for collecting a sample of the steam water droplets at any location or depth in a well to determine the quality of the steam that has arrived at the bottom for injection purposes, for example, compared to the quality of the steam prior to entry into the well.

Another primary object of this invention is to provide at least one method for forming a sampler for sampling steam water droplets at any location in a well.

A further object of this invention is to provide a method for sampling steam at any depth in a well, a method for forming a sampler for sampling steam at any depth in a well, and at least one steam sampler, each of which is easy to operate, is of simple configuration, is economical to build and assemble, and is of greater efficiency for sampling steam at the bottom of a well just prior to penetrating the surface of a petroliferous strata of an oil well, for example.

Other objects and various advantages of the disclosed methods and steam sampler will be apparent from the following detailed description, together with the accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, one form or mechanism for carrying out one method of the invention and for being formed by the other method of the invention wherein like reference numerals have been employed to indicate similar parts in the several views in which.

Figures 1, 3:
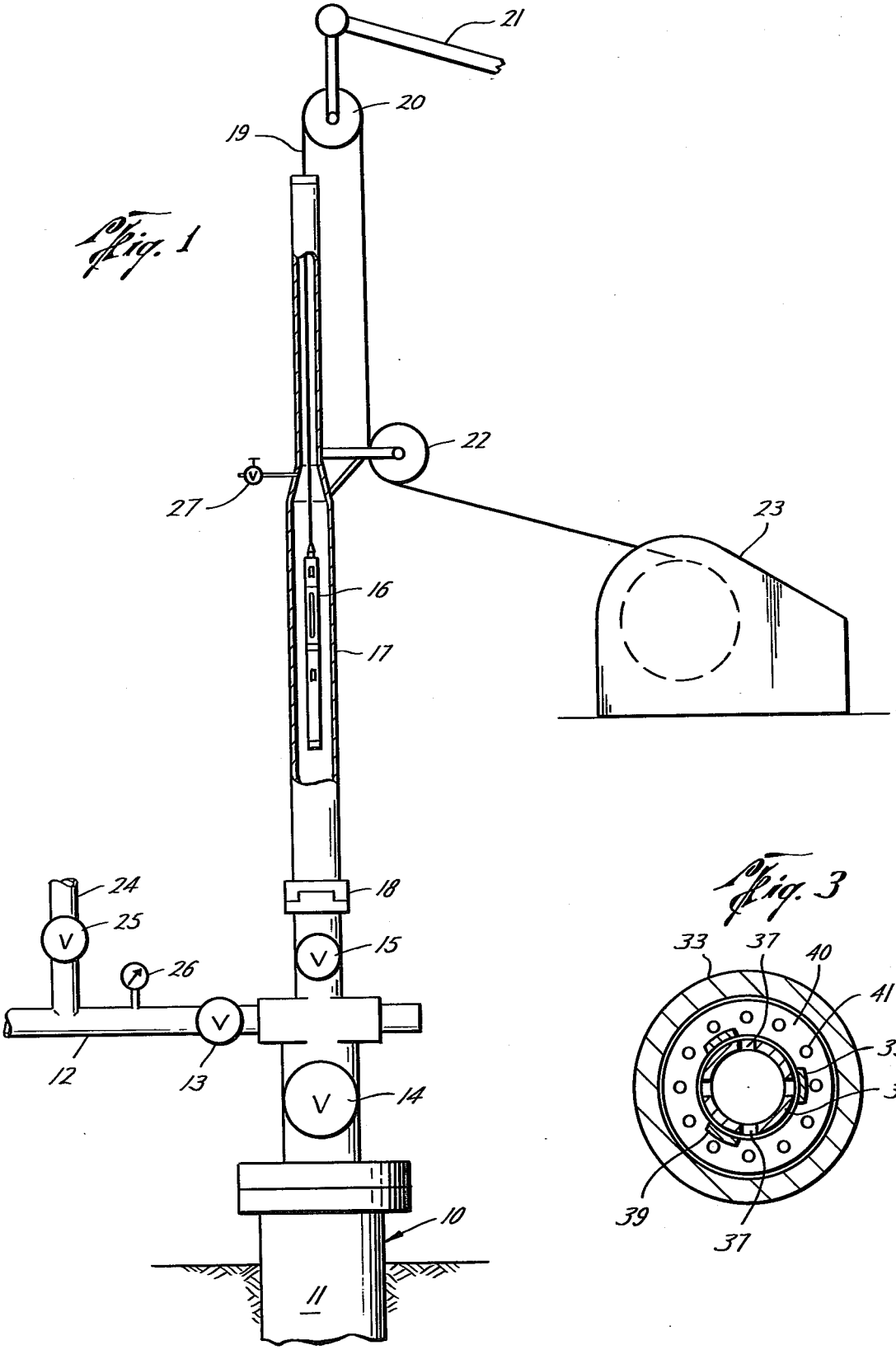
FIG. 1 is a schematic elevational view of the sampler while hanging from a wireline in the upper portion of a well.
FIG. 3 is a sectional view taken at 3—3 of FIG. 2B.

The invention disclosed herein, the scope of which being defined in the appended claims, is not limited in its application to the details of construction and arrangement of parts shown and described for carrying out or made by the disclosed methods, since the invention is capable of other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

Three inventions are described hereinafter, a new method for collecting a sample of the steam water droplets, a new method for forming a sampler, and a new steam sampler.

DESCRIPTION OF THE METHODS

This invention comprises a method for sampling steam at any location from the bottom to the top of a well for determining the quality of the steam just prior to injecting into the formation, and a method for forming a steam sampler.

METHOD FOR SAMPLING STEAM

A typical method of the invention for collecting a liquid water droplet sample of steam at any depth or position in a well having a pressure chamber at the top to determine the quality of the steam that has arrived at the bottom for injection into the petroliferous strata formation relative to the steam quality input at the surface comprises the method steps of, (1) passing the steam that has arrived at the desired location in the well through slots into the upper end of a cylindrical vessel, (2) passing the steam from the slotted upper end of the cylindrical vessel down into an annulus formed between the lower end of the cylindrical vessel and a tube means fixed longitudinally internally of the cylindrical vessel, (3) passing the steam vapor portion that has entered the annulus back out of the annulus through holes in the tube means, (4) passing the steam vapor from the holes in the tube means out of the lower end of the cylindrical vessel, (5) passing the steam water droplets through perforated baffles into the annulus so that spillage and slushing out are prevented when vapor flashing of the water occurs as the pressure is bled off for recovery of the steam water, (6) collecting the steam water droplets in the annulus until the liquid level reaches the lowest opening in the tube means for collecting a predetermined amount of water, as about 190 cc, in the disclosed embodiments of the annulus, and (7) raising the sampler having the sample of steam water droplets therein up into the pressure chamber for recovery at the surface.

More briefly stated the method for collecting a steam sample at any particular location of depth in a well comprises, (1) passing the steam that has arrived at the desired depth of the sampler in the well into an annulus formed between the tube means and the cylindrical vessel, (2) passing the steam vapor into the tube means through openings therein and out the lower end of the tube means, and (3) collecting the steam water droplets in a perforated baffled enclosed annulus, for recovery at the surface.

METHOD FOR FORMING A STEAM SAMPLER

A method for forming a sampler for collecting a liquid phase or water droplets sample of steam at any desired depth or location in a well to determine the quality of the steam that has arrived at that depth for injection into the petroliferous strata formation relative to the steam quality input at the surface comprises the method steps of, (1) forming an elongated cylinder having closed upper and lower ends with a diameter substantially less than that of the well to be sampled, (2) attaching a coupling means on the cylinder upper end for connecting support means thereto for lowering the cylinder to any desired position in the well, such as but not limited to adjacent the well bottom, (3) forming slots in the cylinder upper end for receiving steam, (4) fixedly mounting an open ended elongated tube in the lower end of the cylinder with the tube extending upwardly from its bottom open end to a position below the slots for forming an annulus between the tube and the cylinder for receiving the steam from the slots, (5) perforating the upper end of the tube so that the steam vapor passes into the tube through the perforations therein for exhausting from the cylinder bottom as the steam water droplets collect in the annulus up to the perforations, (6) closing the top of the elongated tube with a cap having legs extending below the perforations for guiding the steam into the annulus, and (7) mounting a suitable number of perforated baffles on the cap legs for preventing spillage and slushing of the hot steam water due to vapor flashing of the water droplets when the pressure is bled off for recovery of the steam water droplets for testing.

A STEAM SAMPLER

While various samplers may be made by the above method, the following is one examplary steam sampler of several which may be manufactured.

FIG. 1 illustrates schematically an injection well 10 for example having casing 11 in which steam is generated on the surface and injected through injection line 12 under high pressure through valves 13 and 14 into the well to emerge at the bottom for penetrating the adjacent petroliferous formation for displacing the oil therein toward production wells nearby.

FIG. 1 illustrates the new steam quality sampler or cylindrical vessel means 16 suspended in a conventional lubricator or pressure chamber 17 removeably mounted with detachable knock-off connection 18 on top of the housing of a third high pressure valve 15. The steam quality sampler is suspended on cable or wireline 19 over first pulley 20 supported by a conventional boom 21. The line 19 continues by second pulley 22 to a wireline unit 23 for reeling in or paying out the line 19 for positioning the steam quality sampler where desired anywhere from in top of the pressure chamber 17 down to the bottom of the well 10.

Steam injection line 12 also has passage 24 with valve 25 for diverting the steam from the well to a vent or another well (neither shown), as well as a pressure gauge 26. Pressure chamber 17 has a bleed valve 27.

Figure 2A:
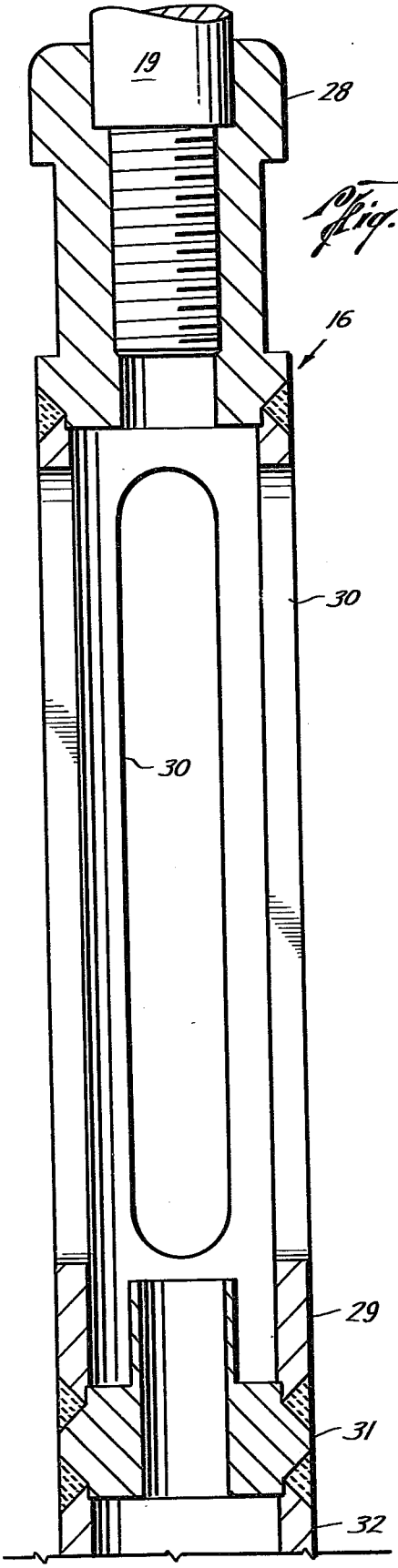
FIG. 2A is a schematic longitudinal section view of the upper portion of one embodiment of the sampler, per se.
Figure 2B:
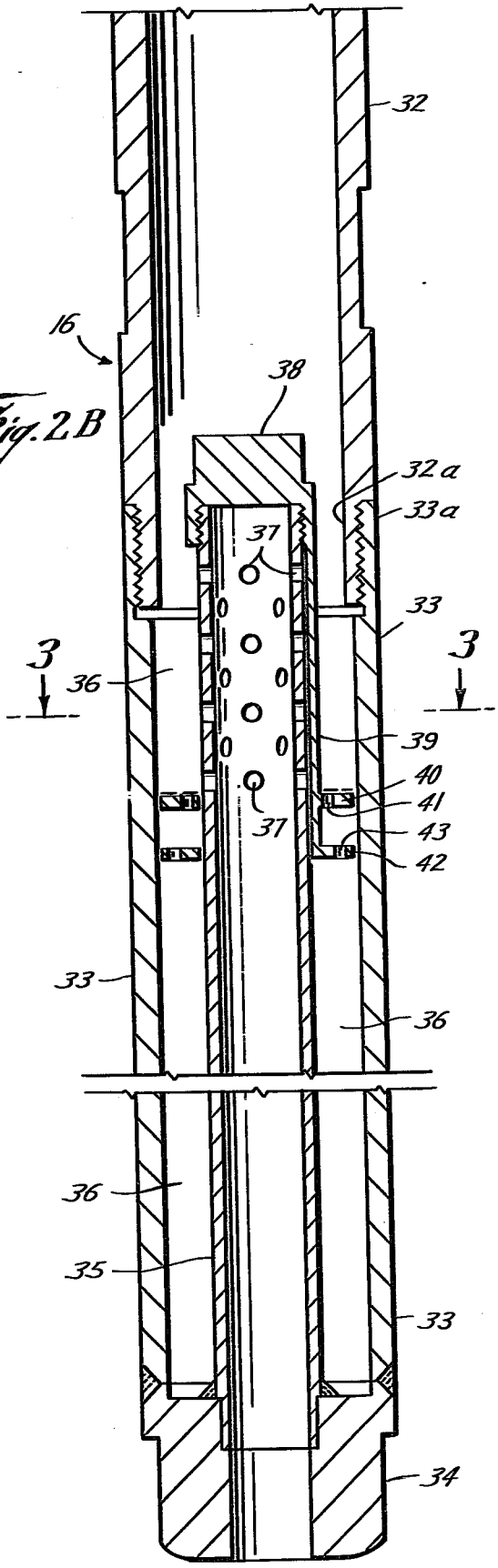
FIG. 2B is a schematic longitudinal sectional view of the lower portion of the sampler of FIG. 2A.

FIG. 2A illustrates in section the upper portion of the sampler 16 and FIG. 2B illustrates in section the lower portion of the sampler.

FIG. 2A is a longitudinal sectional view illustrating details of the upper portion of the new steam quality sampler 16 made by the previously disclosed method. A sucker rod coupling 28 forms the top portion to which is connected the wireline 19 for supporting the steam quality sampler where desired in the well. Under the sucker rod coupling 28 is welded a slotted upper portion 29 having slots 30 around the periphery thereof. A connecting sleeve 31 is welded between the slotted upper portion 29 and an upper cylindrical vessel member 32 for forming an interconnecting passage therebetween.

FIG. 2B discloses the lower sampler portion, wherein a lower cylindrical vessel member 33 has an upper threaded end 33*a* screwed onto a lower threaded end 32*a* of the upper cylindrical vessel member 32. A bottom ring or vessel lower outlet 34 is welded to the bottom of the lower cylindrical vessel portion. An open ended elongated water vapor separation tube 35 is welded to the vessel lower outlet 34 and extends internally of the vessel up to a position just under the slots 30 for forming an annulus 36 between the tube 35 and the upper and lower cylindrical vessel members 32–33. While the above described fixed connections are described as being weld joints, any other suitable type or equivalent connections may be utilized. Likewise while a threaded joint 32*a*–33*a* is preferred between the two upper and lower cylindrical vessel members 32, 33, other suitable detachable joints may be used, if desired.

This water vapor separating tube 35, FIG. 2B, is a principal element in combination with the cylindrical vessel for forming the steam quality sampler. A plurality of holes 37 are formed in the upper end of the water vapor separation tube with the lower holes determining the particular volume of the annulus desired, as 190 cc for example, in the lower cylindrical vessel member 33 for catching and retaining the steam water droplets. A cap 38 screws on top of the water droplets separation tube 35 for closing the upper opening. Cap 38 has three legs 39 extending down below the lowest holes 37 for supporting a suitable number, such as but not limited to, two perforated baffles, 40 and 42, screwed thereon. The baffles 40, 42 each has a plurality of holes 41 and 43, respectively, for permitting the steam water droplets to pass therethrough while the steam vapor passes from the annulus through the holes 37 into the water-vapor separation tube.

Briefly in operation the steam quality sampler 16, FIG. 1 is lowered through open valves 14 and 15 into the well 10 from inside the pressure chamber 17 by paying out the line 19 from the wireline unit 23 to the desired depth. With valve 25 in the diversion passage 24 closed and valve 13 open, a predetermined amount of steam is injected into the well for passing through the steam quality sampler positioned at the particular depth in the well in the petroliferous strata where the quality of steam is desired. After passing through the slots 30, FIG. 2*a*, the steam passes down through connecting sleeve 31, down through the upper cylindrical vessel member 32, and down into the annulus 36, FIG. 2*b*. Here, the steam vapor passes into the water-vapor separation tube 35 through its holes 37, down the tube, and out the vessel lower outlet 34. However, the steam water droplets continue straight down the annulus 36 and through the perforated baffles to the bottom of the annulus.

After the annulus has filled up to the lower row of holes therein of steam water droplets as calculated by the amount of time of steam injection into the well, the steam is cut off or by-passed to passage 24, FIG. 1, to other wells or vented and the steam quality sampler raised to the surface and finally into the pressure chamber 17 where valve 15 is closed and the bleed valve 27 opened slowly. After the pressure is bled off, the pressure chamber is detached from the well, the steam quality sampler removed, and the quality of the steam determined from the remaining liquid. A certain amount of water will boil off until the pressure in the sampler is down to atmospheric pressure and the temperature is below 212° F. (100° C.). Then the lower cylindrical vessel member 33, FIG. 2*b*, is unscrewed from the upper cylindrical vessel member 32 and the sample recovered.

The sample may then be checked for either total dissolved solids or chloride content and compared with the steam generator feed water total dissolved solids or chlorides to determine the quality of the steam or ratio of the total dissolved solids or chlorides in the water droplets at the well bottom or point of injection to the total dissolved solids or chlorides in the feed water at the surface. Conductivity meters provide an easy and simple system for analyzing for total dissolved solids.

The quality "Q" of the steam of a typical sample may be determined as follows (ppm-parts per million):

$$Q(\%) = 100\left(1 - \frac{\text{total dissolved solids entering wellhead}}{\text{total dissolved solids sample}}\right)$$

Total Dissolved Solids (TDS) at generator = 8,000 ppm

Bottomhole TDC = 23,000 ppm

Full Sample = 190 cc

Remaining Sample = 120 cc (70 cc were lost due to flashing to vapor at atmospheric pressure). The TDS was concentrated in proportion to the quantity of water lost.

$$\frac{120\text{cc}}{190\text{cc}}(23{,}000\text{ ppm}) = 14{,}500\text{ ppm}$$

$$Q(\%) = 100\left[1 - \frac{8{,}000}{14{,}500}\right] = 100(1 - .55) = 45\%$$

Preferably the higher the quality of the steam at the point of injecton into the earth, the greater the penetration and the greater the production of oil from the production wells.

Accordingly, the three inventions comprising a new method for collecting steam samples from any location in a well, a new method for forming a steam quality sampler, and a new steam quality sampler for taking steam samples at any depth in a well have been disclosed above.

Obviously other samplers and other methods may be utilized for collecting steam samples and for forming a steam sampler like the embodiment of FIG. 2 than those listed above, depending on the particular information and water droplets or condensate desired.

Accordingly, it will be seen that at least one method for collecting a steam sample at any location in a well, at least one method for forming a steam sampler, and at least one embodiment of a steam sampler have been described which will operate in a manner which meets each of the objects set forth hereinbefore.

While only two methods of the invention and one mechanism have been disclosed, it will be evident that various other methods and modifications are possible in the arrangements and construction of the disclosed methods and steam collecting sampler without departing from the scope of the invention and it is accordingly desired to comprehend within the purview of this invention such methods and modifications as may be considered to fall within the scope of the appended claims.

We claim:

1. A method for collecting a sample of the steam water droplets at any desired location down in a well comprising the steps of, (a) passing the steam that has arrived at the desired location into a cylindrical collecting vessel having a tube means forming an annulus therein, (b) passing the steam vapor and the steam water droplets into the annulus, (c) passing the steam vapor through openings in the upper end of the tube means and out the lower end of the tube means, (d) collecting the steam water droplets in the annulus, and (e) effectively containing the steam water droplets in the annulus with perforated baffles during vapor flashing when recovering the collecting vessel for preventing spillage and slushing of the water.

2. A method as recited in claim 1 wherein the first method step comprises, (a) passing the steam that has arrived at the desired location through slots in the upper end of the collecting vessel, and (b) passing the steam from the slotted upper end of the collecting vessel down through the upper end portion of the collecting vessel.

3. A method as recited in claim 1 wherein the second method step comprises, (a) passing the steam downwardly into the annulus formed between the tube means and the collecting vessel.

4. A method as recited in claim 1 wherein the third method step comprises, (a) passing the steam vapor that has entered the annulus back out of the annulus through openings in the tube means, and (b) passing the steam vapor from the tube means down and out through the lower end of the tube means and the cylindrical collecting vessel.

5. A method as recited in claim 1 wherein the fourth method step comprises, (a) collecting the steam water droplets in the annulus perforated at the top until the water level reaches the lowest opening in the top of the tube means for collecting a predetermined amount of water droplets, and (b) flowing out of the annulus through the tube means openings an amount of water equal to the new steam water droplets collected thereafter to purge the annulus of the first formed steam water droplets.

6. A method as recited in claim 1 wherein additional steps comprise, (a) raising the collecting vessel up into a pressure chamber at the surface, (b) venting the pressure from the pressure chamber down to atmospheric pressure, (c) removing the collecting vessel from the pressure chamber, and (d) removing the steam water from the collecting vessel.

7. A method as recited in claim 1 wherein the fifth method step comprises, (a) effectively preserving the steam water droplets with a plurality of perforated baffles in the top of the annulus during vapor flashing when recovering the water at the surface.

8. A method as recited in claim 1 wherein the first step comprises further, (a) forming the sampler elongated from two interconnected elongated open ended cylindrical vessel members.

9. A method as recited in claim 1 wherein the fifth step comprises further, (a) closing the top of the tube means with a cap having legs extending below the perforations, and (b) mounting at least one perforated baffle on the cap legs for preventing spillage and slushing of the hot steam water droplets due to vapor flashing of the water when the pressure is bled off for recovering of the steam water droplets for testing.

10. A method for forming a sampler for collecting a water droplets sample of steam at any desired location in a well comprising, (a) forming an elongated cylinder having open upper and lower ends with a diameter substantially less than that of the well to be sampled, (b) attaching a coupling means on the cylinder upper end for connecting support means thereto for lowering the cylinder to the desired location in the well, (c) forming slots in the cylinder upper end for receiving steam, (c) fixedly mounting an elongated tube over the cylinder lower open end with the tube upper end extending internally of the cylinder to a position below the slots for receiving the steam from the slots, and for forming a closed end annulus between the elongated tube and the elongated cylinder so that the steam including the steam water droplets and the steam vapor pass down into the annulus, and (e) perforating the upper end of the elongated tube so that the steam vapor passes back into the tube through the perforations therein for exhausting from the cylinder bottom as the steam water droplets collect in a closed end annulus up to the perforations for recovery at the surface.

11. A sampler for collecting a sample of hot steam at any desired location in a well comprising, (a) cylindrical vessel means having a slotted upper end for receiving steam and a lower end for ejecting the steam, (b) coupling means on said upper end for attaching support means thereto for lowering the cylindrical vessel means to a position at the desired location in the well, (c) tube means extending internally of said cylindrical vessel means from a point below said slotted upper end down and out the lower end for receiving steam from said slotted upper end and for forming a closed end annulus between said tube means and said cylindrical vessel means and for ejecting the excess steam from the lower end, (d) an opening in the top of said tube means for permitting steam vapor and water droplets therein to pass into said closed end annulus whereby the steam vapor passes through the openings back into said tube means for ejecting from said lower end and the steam water droplets collect in the closed end annulus, and (e) baffle means mounted in said closed end annulus for preventing spillage of the steam water due to vapor flashing when brought to the surface for recovery.

12. A sampler as recited in claim 11 wherein, (a) said cylindrical vessel means comprises two interconnected upper and lower co-axial cylindrical vessel members fixedly connected together around said tube means so that a substantial portion of said steam passes into said closed end annulus for separation of the steam water droplets from the steam vapor.

13. A sampler as recited in claim 11 wherein, (a) a plurality of holes are formed in an upper portion of said tube means for permitting only the steam vapor to return to said tube means thereby trapping the steam water portion in said closed end annulus, and (b) said lowest hole being positioned in the tube means to permit all excess steam water over a predetermined amount to flow out of the holes to exit downwardly through the tube.

14. A sampler as recited in claim 11 wherein, (a) cap means is mounted on the upper end of said tube means for forcing all steam into said closed end annulus, (b) leg means extending down from said cap means below said openings in said tube means, and (c) said baffle means being mounted on said leg means below said openings for preventing spillage and slushing of said hot steam water due to vapor flashing when the pressure is bled off for recovery of the steam water droplets.

15. A sampler for collecting a sample of hot steam at any desired depth in a well comprising, (a) a collecting vessel having open upper and lower ends, (b) tube means in said collecting vessel for receiving steam from said collecting vessel upper end and for ejecting it through a lower end of said tube means, (c) said tube means forming a closed ended annulus between said tube means and said collecting vessel, (d) openings in said tube means for permitting the steam therein to pass out into said annulus for trapping the steam water droplets in the annulus as the vapor passes back into said tube means for ejection out the bottom of the collecting vessel, and (e) baffle means for preventing spillage and slushing of said hot steam water droplets due to vapor flashing when the pressure is bled off for recovery of the steam water droplets.

16. A sampler as recited in claim 15 wherein, (a) cap means is mounted on the upper end of said tube means for forcing all steam into said annulus, (b) leg means extending down from said cap means below said openings in said tube means, and (c) said baffle means being mounted on said leg means below said openings for preventing spillage and slushing of said hot steam water droplets due to vapor flashing when the pressure is bled off for recovery of the steam water droplets.

* * * * *